US007546649B1

(12) United States Patent
Fleming

(10) Patent No.: US 7,546,649 B1
(45) Date of Patent: Jun. 16, 2009

(54) SHEET SECURING APPARATUS

(76) Inventor: David A Fleming, 401 Clinton St., Medford, OR (US) 97504

( * ) Notice: Subject to any disclaimer, the term of this patent is extended or adjusted under 35 U.S.C. 154(b) by 0 days.

(21) Appl. No.: 12/291,250

(22) Filed: Nov. 7, 2008

(51) Int. Cl.
*A47C 19/00* (2006.01)
*A47C 21/02* (2006.01)

(52) U.S. Cl. ..... 5/504.1; 24/72.5

(58) Field of Classification Search ..... 5/504.1, 5/496, 498, 669, 400; 24/72.5
See application file for complete search history.

(56) References Cited

U.S. PATENT DOCUMENTS

| | | | | |
|---|---|---|---|---|
| 499,855 | A * | 6/1893 | Schroeder | 24/457 |
| 1,195,874 | A | 8/1916 | Thurston | |
| 2,657,441 | A | 11/1953 | Hart | |
| 2,724,881 | A | 11/1955 | Maria | |
| 2,791,784 | A | 5/1957 | Tomsic | |
| 2,857,643 | A | 10/1958 | Tomsic | |
| 3,092,848 | A | 6/1963 | Grónvold | |
| 4,100,632 | A * | 7/1978 | Johnson | 5/496 |
| 4,461,049 | A | 7/1984 | Hámmond | |
| 4,862,541 | A | 9/1989 | Hutton et al. | |
| 5,044,028 | A * | 9/1991 | Sleeth | 5/669 |
| 5,161,276 | A | 11/1992 | Hutton et al. | |
| 5,218,729 | A | 6/1993 | Walton | |
| 6,836,913 | B2 | 1/2005 | Perrin et al. | |
| 7,395,567 | B1 * | 7/2008 | Tetzler | 5/669 |

* cited by examiner

*Primary Examiner*—Alexander Grosz
(74) *Attorney, Agent, or Firm*—Gerald D. Haynes; R. Keith Harrison

(57) ABSTRACT

A sheet securing apparatus includes an apparatus frame and a plurality of sheet engaging members adapted to detachably engage the apparatus frame.

10 Claims, 4 Drawing Sheets

SHEET SECURING APPARATUS

FIELD

The present disclosure relates to apparatus for securing a sheet on a mattress. More particularly, the present disclosure relates to a sheet securing apparatus which secures the corner portions of a sheet on a mattress to prevent the sheet from pulling loose on the mattress.

BACKGROUND

Conventional bedding typically includes a frame which may have a headboard or both a headboard and footboard. A box springs is placed on the frame and a mattress is placed on the box springs. A fitted sheet is typically placed on the mattress and a bottom sheet is placed over the fitted sheet. A top sheet is typically placed over the bottom sheet. At least one blanket may be placed over the top sheet. Finally, a bedspread may be placed over the top sheet or blanket(s).

The fitted sheet may include four corner pockets which receive the respective corners of the mattress. The four corners of each of the bottom sheet, the top sheet and the blanket (s) are typically tucked between the box springs and the mattress at the four corners of the mattress. One of the problems which is frequently encountered in using conventional bedding is that the bottom sheet, the top sheet and/or the blanket(s) tend to be pulled from between the box springs and the mattress. This may require that the sheets and/or blanket (s) be repeatedly and frequently tucked between the box springs and the mattress.

Therefore, a sheet securing apparatus which secures the corner portions of a sheet and/or blanket on a mattress to prevent the sheet and/or blanket from pulling loose on the mattress is needed.

SUMMARY

The present disclosure is generally directed to a sheet securing apparatus which secures the corner portions of a sheet and/or blanket on a mattress to prevent the sheet and/or blanket from pulling loose on the mattress. An illustrative embodiment of the sheet securing apparatus includes an apparatus frame and a plurality of sheet engaging members adapted to detachably engage the apparatus frame.

BRIEF DESCRIPTION OF THE DRAWINGS

The disclosure will now be made, by way of example, with reference to the accompanying drawings, in which.

DETAILED DESCRIPTION

Figure 1:
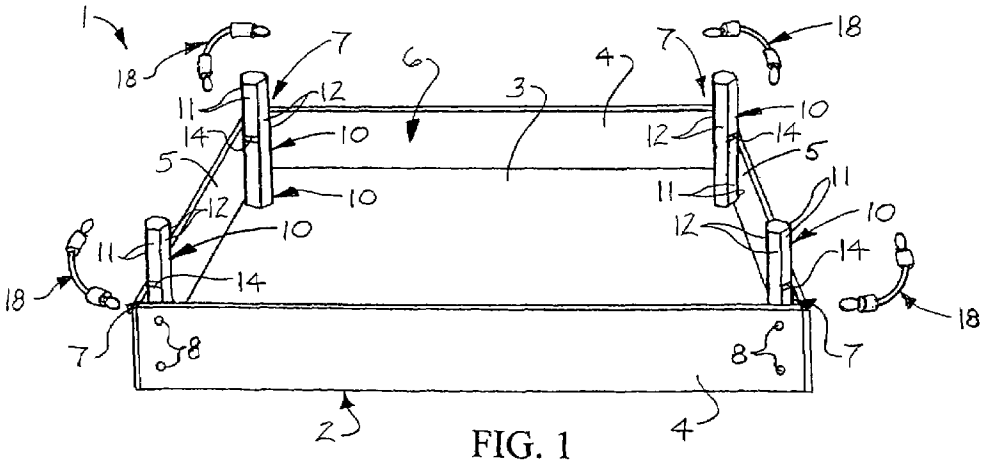
FIG. 1 is an exploded perspective view of an illustrative embodiment of the sheet securing apparatus.
Figure 2:
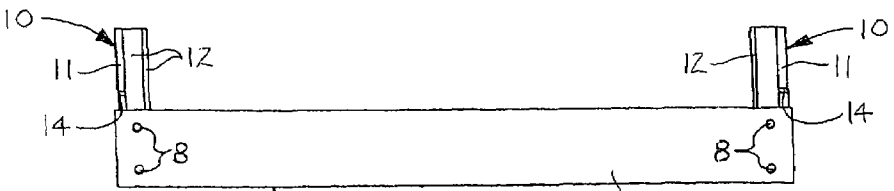
FIG. 2 is a side view of an apparatus frame of an illustrative embodiment of the sheet securing apparatus.
Figure 3:
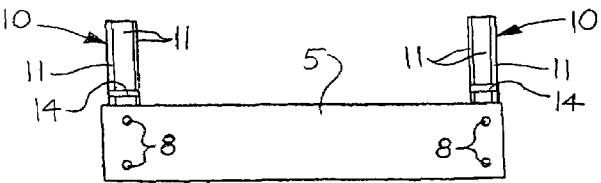
FIG. 3 is an end view of the apparatus frame of an illustrative embodiment of the sheet securing apparatus.
Figure 4:
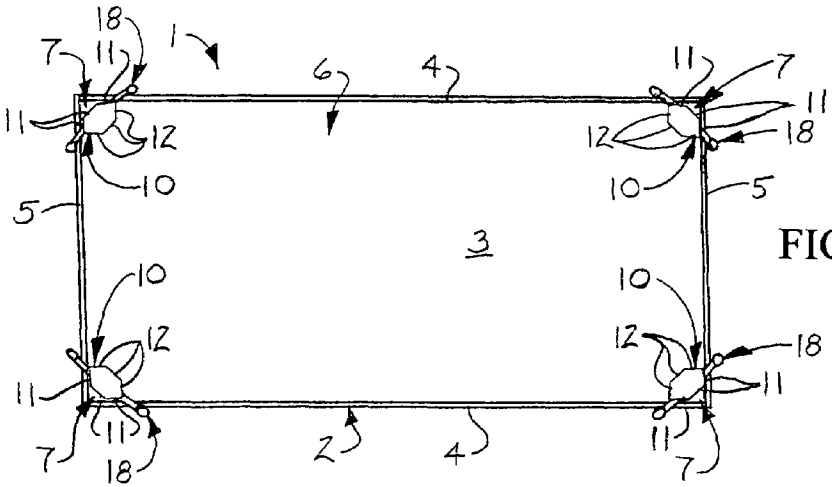
FIG. 4 is a top view of an illustrative embodiment of the sheet securing apparatus, with multiple sheet engaging members inserted in respective engaging member insertion slots (not illustrated) of the apparatus.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Referring initially to FIGS. 1-6 of the drawings, an illustrative embodiment of the sheet securing apparatus, hereinafter apparatus, is generally indicated by reference numeral 1. The sheet securing apparatus 1 includes an apparatus frame 2. The apparatus frame 2 of the apparatus 1 may have a generally elongated, rectangular shape, as illustrated, or any suitable alternative shape. The various components of the apparatus frame 2, which will be hereinafter described, may be wood; metal; plastic; and/or other rigid material. In some embodiments, the apparatus frame 2 may include a bottom frame panel 3; a pair of generally elongated, parallel, spaced-apart side frame members 4; a pair of generally elongated, parallel, spaced-apart end fame panels 5 which extend between the side frame members 4; and a frame interior 6. The frame interior 6 may have frame interior corners 7.

Multiple sheet securing posts 10 may extend from the frame interior 6 of the apparatus frame 2, at the respective frame interior corners 7. The sheet securing posts 10 may be disposed in generally perpendicular relationship with respect to the plane of the bottom frame panel 3 of the apparatus frame 2. The side frame panels 4 and the end frame panels 5 may be attached to the sheet securing posts 10 using fasteners 8 and/or other suitable technique known by those skilled in the art. In some embodiments, each sheet securing post 10 may have a generally hexagonal cross-section. Accordingly, three outer post surfaces 11 may face the exterior of the apparatus frame 2 and three inner post surfaces 12 may face the frame interior 6 of the apparatus frame 2. An elongated engaging member insertion slot 14, the purpose of which will be hereinafter described, extends into the outer post surfaces 11 of each sheet securing post 10.

Figure 6:
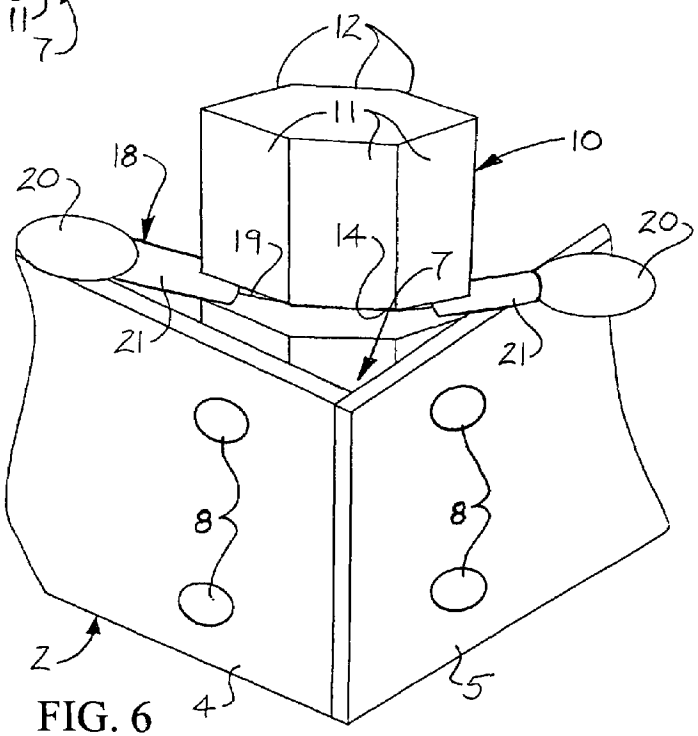
FIG. 6 is a perspective view, partially in section, of a corner section of the apparatus frame, with a sheet engaging member inserted in an engaging member insertion slot provided in the apparatus frame.
Figure 5:
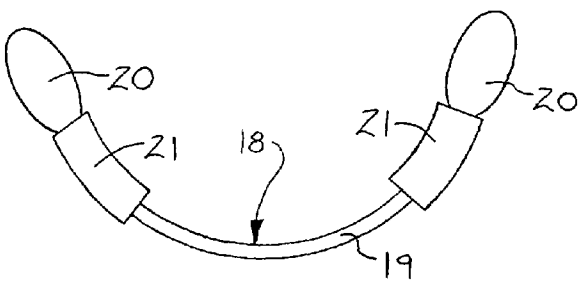
FIG. 5 is a top view of a sheet engaging member of an illustrative embodiment of the sheet securing apparatus.

As illustrated in FIGS. 5 and 6, a sheet engaging member 18 is adapted for insertion in the engaging member insertion slot 14 of each sheet securing post 10. Each sheet engaging member 18 may include a generally elongated connecting member 19 which may be flexible. In some embodiments, the connecting member 19 may be an elastic cord. The connecting member 19 may have a pair of bulbous ends 20. In some embodiments, a spacer 21 may extend along a portion of the connecting member 19 adjacent to each end 20. As illustrated in FIG. 6, in typical application of the sheet securing apparatus 1, the spacers 21 of each sheet engaging member 18 is adapted for lengthwise insertion in the engaging member insertion slot 14 of each sheet securing post 10 for purposes which will be hereinafter described.

Figure 7:
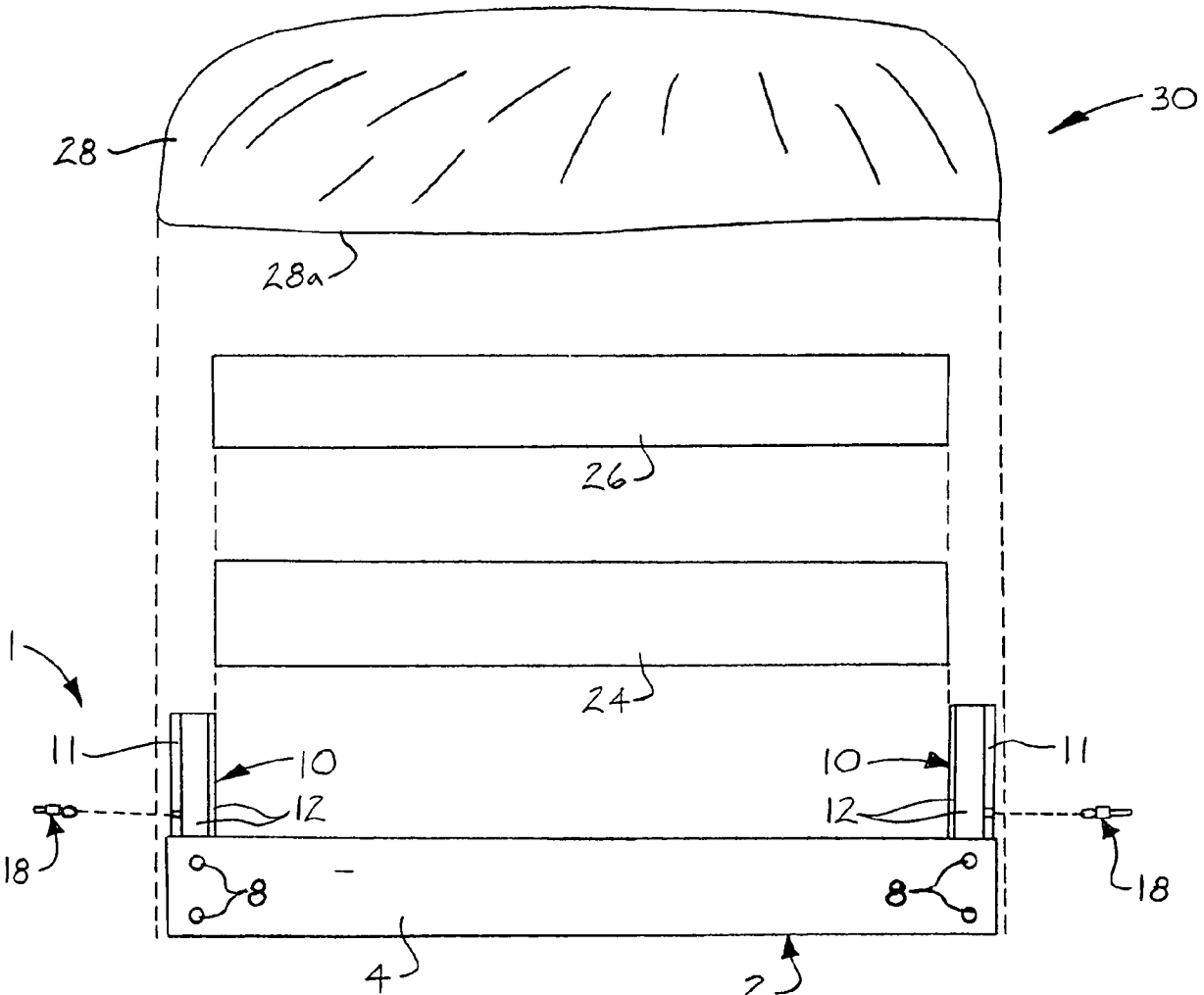
FIG. 7 is an exploded side view of an illustrative embodiment of the sheet securing apparatus, more particularly illustrating placement of a box springs on the apparatus frame; placement of a mattress on the box springs; and placement of a sheet over the mattress preparatory to securing the sheet to the apparatus frame.

Referring next to FIGS. 7-11 of the drawings, in typical application the apparatus 1 is used to secure at least one sheet 28 to a mattress 26 of a bed 30. Accordingly, as illustrated in FIG. 7, a box springs 24 may be placed on the bottom frame panel 3 of the apparatus frame 2. A mattress 26 may be placed on the box springs 24. At least one sheet 28, which may be or include at least one blanket, is placed on the mattress 26. In some applications, a fitted sheet (not illustrated) may be fitted to the mattress 26 prior to placement of the sheet 28 on the mattress 26. The sheet edge 28*a* of the sheet 28 may hang downwardly over the sides of the box springs 24. Alternatively, the edges 28*a* of the sheet 28 may be inserted or tucked between the box springs 24 and the mattress 26. The sheet 28 hangs over the sheet securing posts 10 of the apparatus 1.

Figure 10:
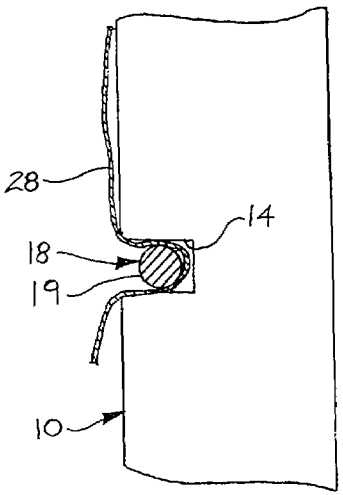
FIG. 10 is a sectional view illustrating retention of a portion of the sheet in an engaging member insertion slot provided in the apparatus frame in typical application of the sheet securing apparatus.
Figure 8:
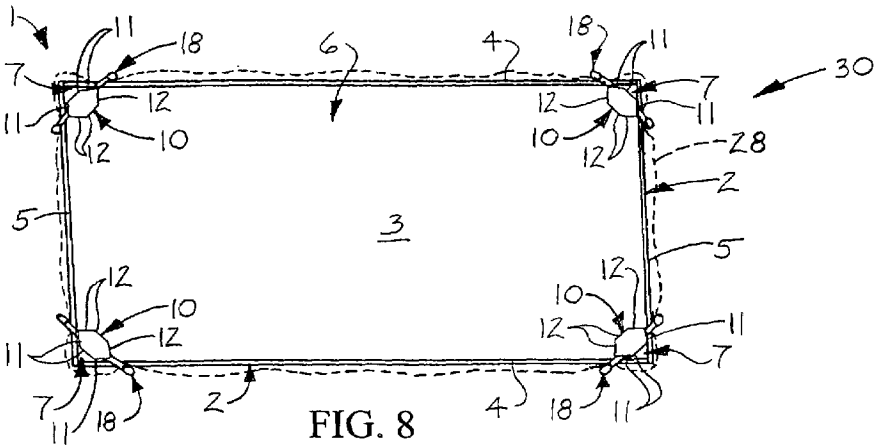
FIG. 8 is a top view of an illustrative embodiment of the sheet securing apparatus, with a sheet (illustrated in phantom) secured to the apparatus frame in typical application of the sheet securing apparatus.
Figure 9:
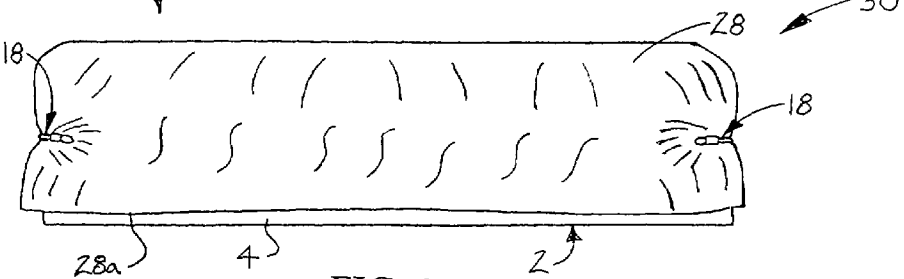
FIG. 9 is a side view of an illustrative embodiment of the sheet securing apparatus, with a sheet secured in place in typical application of the sheet securing apparatus.
Figure 11:
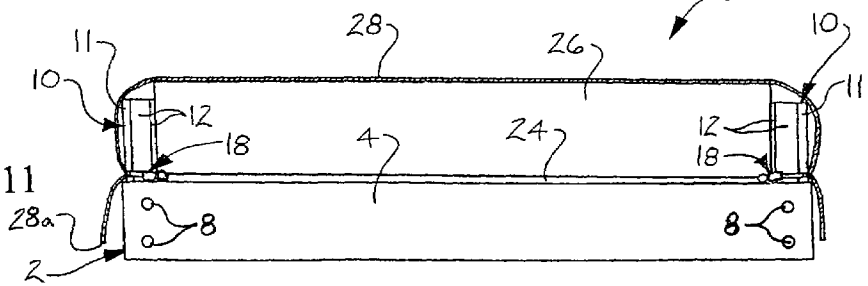
FIG. 11 is a longitudinal sectional view illustrating securing of the sheet to the mattress using the sheet securing apparatus illustrated in FIG. 9.

As illustrated in FIGS. 9 and 11, each sheet engaging member 18 is inserted in the engaging member insertion slot 14 of each sheet securing post 10. As illustrated in FIG. 6, the spacers 21 of each sheet engaging member 18 may be sized to friction fit between the interior upper and lower surfaces of each engaging member insertion slot 14. Accordingly, as illustrated in FIG. 10, the sheet 28 is secured between the interior of each engaging member insertion slot 14 and the connecting member 19 of the corresponding sheet engaging member 18. Therefore, as illustrated in FIG. 8, the sheet engaging members 18 secure the respective corner portions of the sheet 28 to the respective sheet securing posts 10. Additional sheets and/or blankets (not illustrated) may be placed over the sheet 28 in preparation of the bed 30. The additional sheets and blankets (not illustrated) may lie on the secured sheet 28 or alternatively, may be secured to the sheet securing posts 10 using some or all of the sheet engaging members 18 as was heretofore described with respect to securing of the sheet 28. During subsequent use of the bed 30, the sheet engaging members 18 secure the sheet 28 to the sheet securing posts 10 and prevent detachment of the sheet 28 from the mattress 26. The sheet 28 may be selectively detached and removed from the bed 30 by removing the sheet engaging members 18 from the respective engaging member insertion slots 14 and removing the sheet 28 from the mattress 26.

While the illustrative embodiments of the disclosure have been described above, it will be recognized and understood that various modifications can be made and the appended claims are intended to cover all such modifications which may fall within the spirit and scope of the disclosure.

What is claimed is:

1. A sheet securing apparatus, comprising:

a generally elongated, rectangular apparatus frame having a frame interior and a plurality of sheet securing posts in the frame interior at respective corners of the apparatus frame, the frame comprises a pair of generally elongated, parallel, spaced-apart side frame panels and a pair of generally elongated, parallel, spaced-apart end frame panels extending between the side frame panels;

an engaging member insertion slot provided in each of the plurality of sheet securing posts, respectively; and an elastic sheet engaging member adapted for removable insertion in the engaging member insertion slot, wherein each of the plurality of sheet engaging members comprises a generally elongated, elastic connecting member and a pair of bulbous ends terminating respective ends of the connecting member.

2. The sheet securing apparatus of claim 1 further comprising a pair of spacers provided on the connecting member adjacent to the bulbous ends, respectively.

3. The sheet securing apparatus of claim 1 wherein each of the sheet securing posts has a generally hexagonal cross-section.

4. The sheet securing apparatus of claim 3 wherein each of the sheet securing posts comprises a plurality of inner post surfaces generally facing the frame interior of the frame and a plurality of outer post surfaces generally facing away from the frame interior of the frame.

5. The sheet securing apparatus of claim 4 wherein the engaging member insertion slot extends into the plurality of outer post surfaces.

6. A sheet securing apparatus, comprising:

a generally elongated, rectangular apparatus frame comprising:

a pair of generally elongated, parallel, spaced-apart side frame panels;

a pair of generally elongated, parallel, spaced-apart end frame panels extending between the side frame panels;

a bottom frame panel provided on the side frame panels and the end frame panels;

a frame interior defined by the side frame panels, the end frame panels and the bottom frame panel;

a plurality of sheet securing posts extending from the bottom frame panel in the frame interior at respective corners of the apparatus frame; and an engaging member insertion slot provided in each of the plurality of sheet securing posts, respectively; and a generally elongated, elastic sheet engaging member adapted for removable insertion in the engaging member insertion slot.

7. The sheet securing apparatus of claim 6 wherein each of the plurality of sheet engaging members comprises a generally elongated, elastic connecting member and a pair of bulbous ends terminating respective ends of the connecting member.

8. The sheet securing apparatus of claim 6 wherein each of the sheet securing posts has a generally hexagonal cross-section.

9. The sheet securing apparatus of claim 8 wherein each of the sheet securing posts comprises a plurality of inner post surfaces generally facing the frame interior of the frame and a plurality of outer post surfaces generally facing away from the frame interior of the frame.

10. The sheet securing apparatus of claim 9 wherein the engaging member insertion slot extends into the plurality of outer post surfaces.

* * * * *